United States Patent [19]

Hau

[11] Patent Number: 4,750,424

[45] Date of Patent: Jun. 14, 1988

[54] RUNNING TIME DISPLAY FOR A PROJECTILE TIME FUZE

[75] Inventor: Heinz Hau, Erlensee, Fed. Rep. of Germany

[73] Assignee: Honeywell Regelsysteme GmbH, Fed. Rep. of Germany

[21] Appl. No.: 23,024

[22] Filed: Mar. 6, 1987

[30] Foreign Application Priority Data

Mar. 6, 1986 [DE] Fed. Rep. of Germany ..... 3607372

[51] Int. Cl.[4] ..... F42C 9/00

[52] U.S. Cl. ..... 102/200; 102/221; 102/293

[58] Field of Search ..... 102/200, 215, 221, 264, 102/265, 218, 293; 89/6

[56] References Cited

U.S. PATENT DOCUMENTS

| | | | |
|---|---|---|---|
| 1,541,790 | 6/1925 | Cheley et al. | 102/264 X |
| 2,826,991 | 3/1958 | Beach | 102/264 X |
| 4,586,436 | 5/1986 | Denney et al. | 102/200 X |
| 4,594,944 | 6/1986 | Rongus et al. | 102/264 X |
| 4,632,031 | 12/1986 | Jarrott et al. | 102/200 |
| 4,633,779 | 1/1987 | Biggs et al. | 102/215 |

*Primary Examiner*—Ted L. Parr

*Attorney, Agent, or Firm*—Mitchell J. Halista; Albin Medved

[57] ABSTRACT

A running time display for a projectile time fuze uses a digital display visible through a transparent window in a nose of the projectile. The fuze running time can be programmed either electrically by a receiving coil within the nose or manually by a time setting ring on the surface of the nose. To facilitate a running time display during adverse visibility conditions, the display may comprise LED elements with the display elements being intermittently energized to reduce electrical power consumption from a battery powering the time fuze.

4 Claims, 4 Drawing Sheets

M-COMPUTER
OSC
TO "34"

RUNNING TIME DISPLAY FOR A PROJECTILE TIME FUZE

BACKGROUND OF THE INVENTION

1. Field of the Invention

The present invention relates to a time fuze for a projectile. More specifically, the present invention is directed to an electrically programmable time fuze having a visible running time display.

2. Description of the Prior Art

Time fuzes are conventionally wireless programmed for a projectile flight time by an external programming unit via an inductively transferred programming sequence to control the fuze running time. During such a wireless programming, no provision has been available on the projectile to monitor the programmed fuze running time.

SUMMARY OF THE INVENTION

An object of the present invention is to provide a display for monitoring an inductively programmed running time of a time fuze located within the nose of a projectile.

In accomplishing this and other objects, there has been provided, in accordance with the present invention, a running time display for a projectile time fuze using a digital display visible through a transparent window in a nose of the projectile containing an inductively programmable fuze running time via a receiving coil within the nose.

BRIEF DESCRIPTION OF THE DRAWINGS

A better understanding of the present invention may be had when the following detailed description is read in connection with the accompanying drawings in which.

DESCRIPTION OF THE PREFERRED EMBODIMENT

Figure 1:
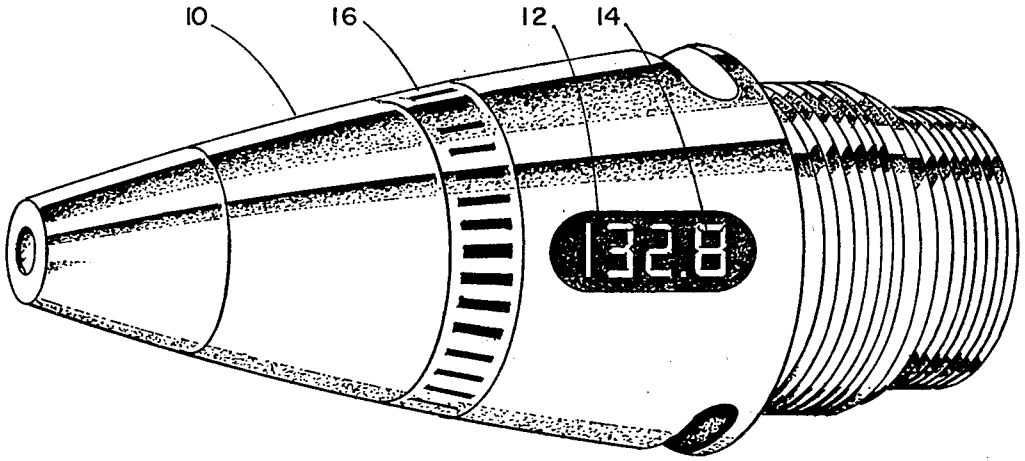
FIG. 1 is a pictorial perspective illustration of a projectile nose having a visible running time display.

As shown in FIG. 1, a projectile nose 10 is provided with a transparent window 12 through which a digital display 14 within the projectile's nose 10 is visible. The display 14 is preferably formed by light emitting diodes (LED's) which provide a visible display under adverse conditions such as low temperatures and low external light levels. Further, the LED display can be intermittently operated at a frequency high enough to avoid flicker while conserving electrical power from the electrical source powering the display and the time fuze. The digital display 14 is programmed either manually by means of a setting ring 16 on the surface of the nose, which cooperates with an internal electrical contact or inductively by means of an internal coil connected in a time fuze circuit. The adjusted time is preferably displayed in seconds so that the digit after the decimal point shows the one-tenth of a second.

Figure 2:
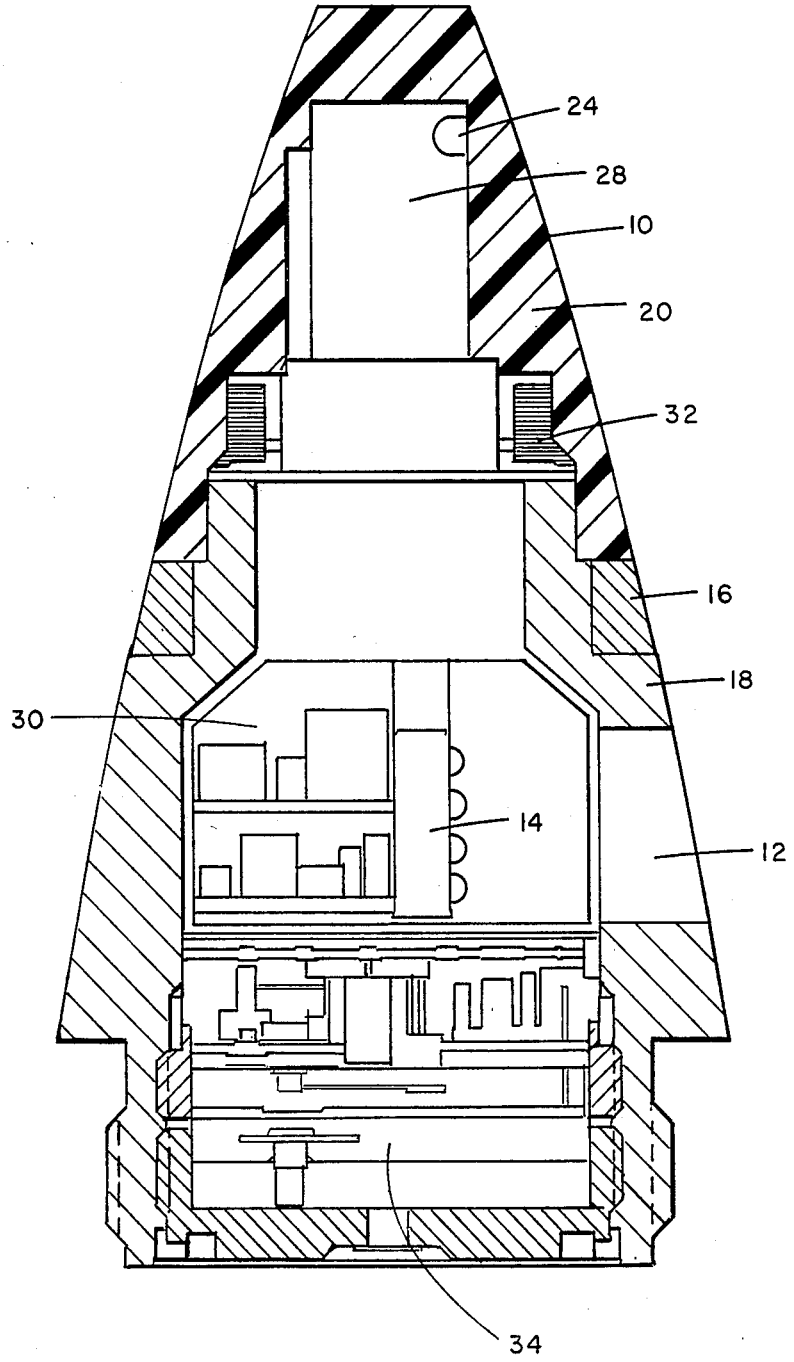
FIG. 2 is a cross-sectional illustration of the projectile nose shown in FIG. 1.

As shown in FIG. 2, the projectile nose 10 comprises a rear portion of a metallic housing 18 and a front portion of a plastic housing 20. The front portion 20 includes a central cutout or space 24 which accommodates a long-life battery 28, e.g., a lithium battery. When assembling the plastic portion 20 onto the housing portion 18, electrical contact is made between the battery 28 and an electronic package 30 arranged withing the metallic housing 18 by any suitable means, not shown. The electronics 30 controls the digital display 14, the digits of which are visible to the outside of the nose 10 by means of the window 12. The programming of the digital display 14 is manually achieved by rotating the setting ring 16 until it comes to a stop, whereby an electrical contact, not shown, cooperating with the electronics 30 is actuated. A receiving coil 32 is arranged concentrically with the axis of the projectile nose 10 within the plastic portion 20 and is also connected to the electronics 30 in any suitable manner, not shown. By means of the receiving coil 32, the time fuze may be. electrically, i.e., inductively, programmed. Within the rear portion of the projectile nose 10, a mechanical assembly 34 is provided which comprises in a known manner a nose locking device, an explosive primer and a launch interface with switching means for sensing the primer circuit and the launching of the projectile.

Figure 3:
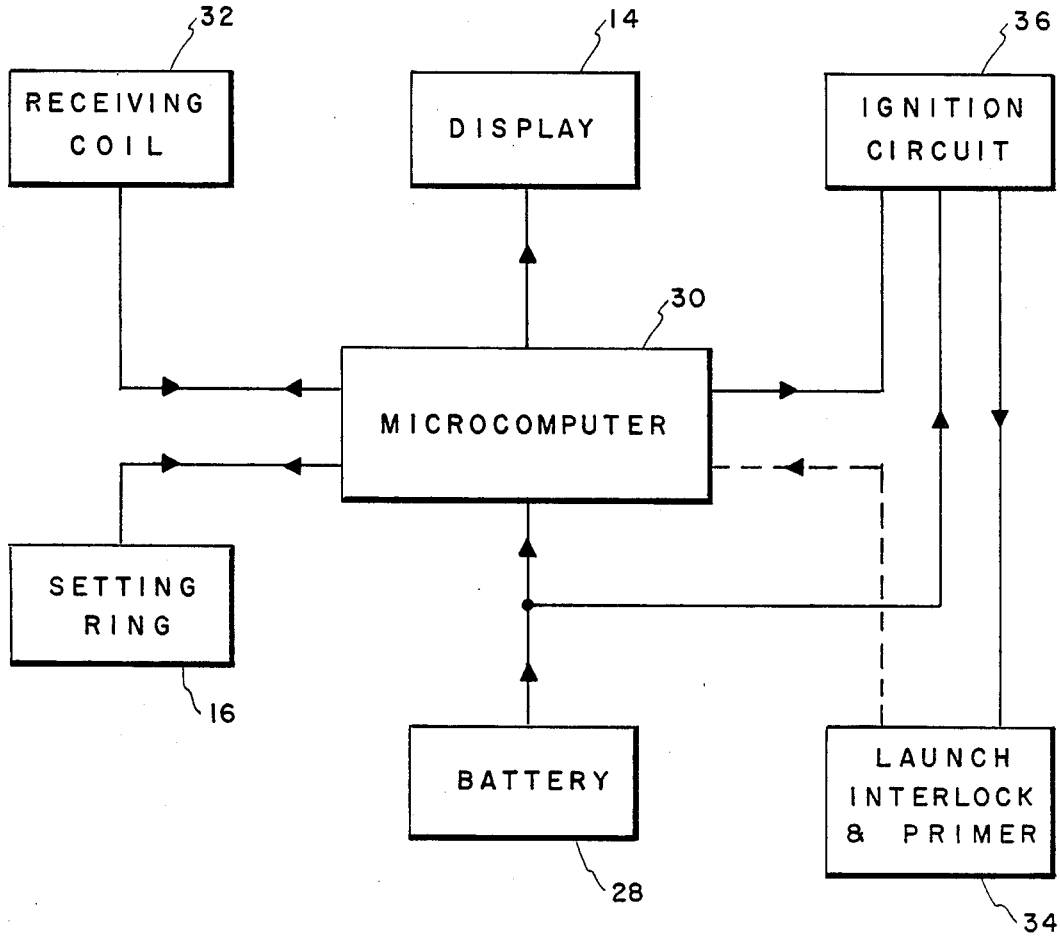
FIG. 3 is a block diagram of the time fuze used in the projectile nose shown in FIGS. 1 and 2 and FIG. 4 is a schematic illustration of the time fuze shown in FIG. 3.

FIG. 3 shows the elements of FIG. 2 in a block diagram. A principal component of the time fuze is the electronic package 30 comprising a suitable microcomputer which is energized by the battery 28. At the same time the battery 28 supplies an ignition circuit 36 which is controlled by the electronics 30. The ignition circuit 36 can only act upon the explosive primer via the locking device in the assembly 34 after a launching of the projectile. A fuze running time may be electrically, i.e., inductively, adjusted within the electronics 30 via the receiving coil 32 or manually by an actuation of the setting ring 16, and the running time is displayed by the digital display 14.

Figure 4:
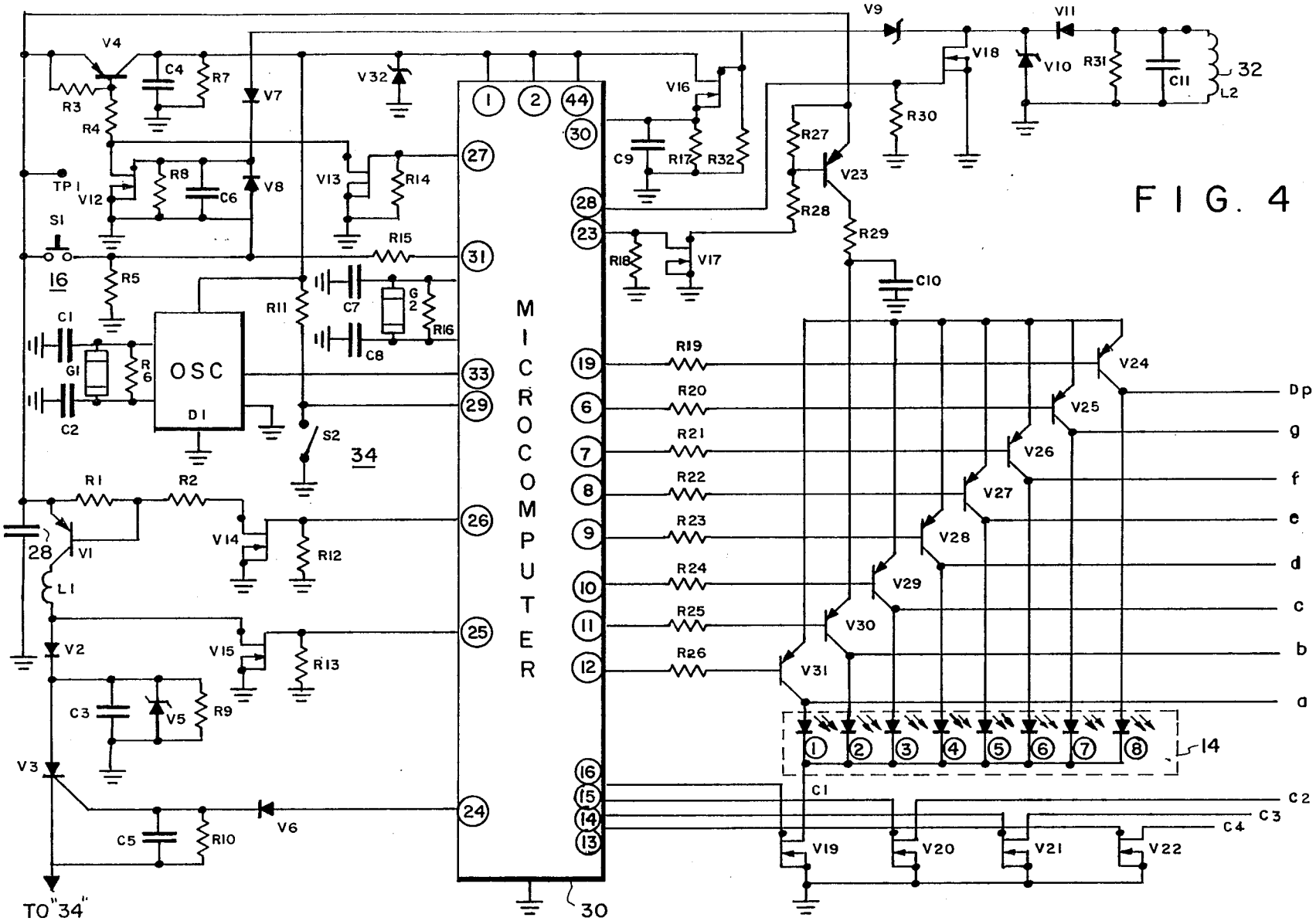

FIG. 4 shows the circuit details of the electronics 30. The illustrated circuit device shall be further described in the following with respect to its basic configuration and function:

First, the operation and circuit for an electronic fuze setting. In this operation, an alternating electromagnetic field having a predetermined frequency, e.g., 100 kHz, is supplied by a suitable external programming unit, not shown, with the field being received by a resonant circuit consisting of the coil L2 and the capacitor C11 and being rectified by diodes V11 and V7 to charge a capacitor C6. Herewith an MOS transistor V12 and a further transistor V4 are switched "on". By switching "on" transistor V4, the battery voltage provided by the battery 28 is applied to the terminal 44 of a suitable microcomputer 32. This produces an oscillating frequency signal from an internal oscillator which comprises a quartz crystal G2, a resistor R16 and capacitors C7, C8. After expiration of an initialization time of 500 ms, the program sequence corresponding to the running time and given by a bit pattern supplied from the coil L2 may be serialiy read in ast the input terminal 30 of the microcomputer 30 by means of a program logic comprising the components V16, R17 and C9.

After the running time programming, a further frequency of 100 kHz is received from the external programming unit. According to the program information which has been received at the terminal 30 of the microcomputer 30, the MOS transistor V18 is cyclically controlled via the output 28 of the microcomputer 30.

This results in a short circuit at the resonant circuit of L2 and C11, which short circuit is sensed via a phase shift in the transmitting coil of the programming unit as an information signal transmitted by the microcomputer 30. This information is compared to the setting in the programming unit whereupon the result of the programming is indicated as being positive or negative, respectively. Subsequently, the magnetic field radiated by the programming unit is switched off.

The manual setting of the fuze running time is done via the setting ring 16 which is represented in FIG. 4 by the switch contact S1. The MOS transistor V12 and therefore also transistor V4 is switched "on" via the setting ring S1 and the diode V8 which results in supplying the microcomputer 30 at its terminal 44 with electrical energy from the battery 28. After terminal 31 of the microcomputer D2 has sensed a manual programming, MOS transistor V13 is controlled via terminal 27 to switch "on" transistor V4 which determines the switch "on" time of the supply voltage for the microcomputer 30. By actuating the setting ring S1 in a certain sequence ("ON"-"OFF") the fuze running time information is supplied. If the predetermined sequence is not followed, e.g., only three digits are adjusted, then the fuze is automatically adjusted to the running time of "000.0" per program so that at a launching no fuze function results. After a successful manual programming, the running time information is stored for a certain time in the same manner as it is done for an inductive programming. This is achieved via the terminal 27 of the microcomputer 30 as well as via the components F14, V13, R3, R4, C4 and V4. After expiration of the storage time, the terminal 27 of the microcomputer 30 is set to "0" which results in switching "off" of the energy supply via the transistor V4. A manual or inductive overriding programming is possible at any time.

With the running time data, the display segments of the light emitting diode display 14 are controlled. Implementation of this display is via the terminals 6, 12 and 19 of the microcomputer 30 whereby the transistors V24–V31 for the seven display segments as well as for the decimal point are controlled. Via the terminals 13–16 of the microcomputer 30, the transistors V19–V22 for each decimal place are selected. The transistors V19–V22 each control the light emitting diode segments LED1–LED7 for a decimal place as well as a light emitting diode segments LED8 for the decimal point. The transistors V19–V22 switch the operating voltage to LED segments under the presumption that the transistor V24–V31 also connected in series to the light emitting diode segments are also controlled by the microcomputer 30. An intermittent control of those transistors V24–V31 is done subsequently in order to save electrical energy.

If the projectile with the fuze is launched within the predetermined stored running time of the flight information, then switch S2 is closed via the mechanical locking device 34 which condition is sensed at terminal 29 of the microcomputer 30. An impact mode is not provided within this embodiment but may be implemented. After launching, the stored flight time is decremented in a known manner. Furthermore, an output from a second or safety oscillator D1 is cyclically sensed at the terminal 33 of the microcomputer 30 and compared to the main oscillator formed by G2, R16, C7, C8 to prevent a premature primer ignition due to a defective oscillator quartz G2 which possibly may be not operable. Before reaching the point of primer ignition time, terminal 26 of the microcomputer 30 switches "on" MOS transistor V14 and, therefore, also transistor V1 in order to provide the ignition energy by connecting the battery voltage to the primer ignition circuit. By a blocking oscillator circuit consisting of the coil L1, the MOS transistor V14 and the diode V2, the priomer ignition capacitor C3 is charged via terminal 25 of the microcomputer 30 by cyclically controlling the transistor V14. Zener diode V5, which is connected in parallel to the capacitor, serves to limit the voltage of the capacitor C3. When reaching the time of ignition point, terminal 24 of the microcomputer 30 discharges the capacitor C3 via the components V6, R10, C5 and the thyristor V3 to the primer which results in primer ignition.

The manual setting of the running time, which may be provided as an emergency function, is done in the following way. Herewith it is to note that the contact being actuated by the setting ring is normally open ("OFF") if the setting ring 16 as regarded from the nose point takes a stop osition in clockwise direction. On the other hand, the contact is actuated, i.e., closed, ("ON") by the setting ring 16 if the setting ring 16 has been rotated to a stop in counterclockwise direction.

Sequence of manual setting:

A—Actuating of setting ring 16 to "ON" *Adjusted time is indicated (000.0 if no time is adjusted)

B—Setting ring is not actuated "OFF" *After five seconds the display is cleared

C—"ON" within five seconds *Programming is started 0.1 seconds are incremented

D—"OFF" *0.1 seconds are stopped and displayed

—The further setting of the 1, 10, 100 seconds is done sequentially as described under steps C and D by a repetition thereof.

E—After the programming is done, the time information is stored for a set time. Thereafter, the power source is switched "off".

F—"ON" same as under step A and "OFF" same as under step B

*Time is displayed (If the displayed time has the value 000.0, the power source is switched "off").

According, it may be seen that there has been provided, in accordance with the present invention, a visible running time display for an inductive programmed projectile time fuze in a projectile nose.

The embodiments of the present invention in which an exclusive property or privilege is claimed are defined as follows:

1. An externally visible running time display for a projectile time fuze arranged within the nose portion of a projectile, the running time of said time fuze being wireless or manually programmable comprising a transparent window in said projectile's nose portion and a digital display means for displaying said running time arranged within said projectile's nose portion, said window affording a view of said running time displayed by said display means.

2. A time fuze according to claim 1 wherein said display means includes a plurality of light emitting diodes.

3. A time fuze according to claim 2 wherein said light emitting diodes in said digital display are intermittently controlled.

4. A time fuze according to claim 3 wherein said display means includes a microcomputer which controls transistors connected in series to said light emitting diodes in said digital display.

* * * * *